US005734402A

United States Patent [19]

Rousseau et al.

[11] Patent Number: 5,734,402

[45] Date of Patent: Mar. 31, 1998

[54] SOLID INK STICK FEED SYSTEM

[75] Inventors: Gerard H. Rousseau, Portland; Brent R. Jones, Tualatin; David W. Johnson, Tigard; John A. Wright, Molalla, all of Oreg.

[73] Assignee: Tekronix, Inc., Wilsonville, Oreg.

[21] Appl. No.: 612,376

[22] Filed: Mar. 7, 1996

[51] Int. Cl.[6] ..... B41J 2/175

[52] U.S. Cl. ..... 347/88

[58] Field of Search ..... 347/88

[56] References Cited

U.S. PATENT DOCUMENTS

| | | | |
|---|---|---|---|
| 4,609,924 | 9/1986 | De Young | 346/1.1 |
| 4,682,185 | 7/1987 | Martner | 346/140 |
| 4,682,187 | 7/1987 | Martner | 346/140 |
| 4,870,430 | 9/1989 | Daggett et al. | 346/140 |
| 5,442,387 | 8/1995 | Loofbourow et al. | 347/88 |
| 5,510,821 | 4/1996 | Jones et al. | 347/88 |

FOREIGN PATENT DOCUMENTS

| | | | |
|---|---|---|---|
| 405155012 | 6/1993 | Japan | 347/88 |
| 406143609 | 5/1994 | Japan | 347/88 |

*Primary Examiner*—Edgar S. Burr
*Assistant Examiner*—Leslie Grohusky
*Attorney, Agent, or Firm*—Ralph D'Alessandro

[57] ABSTRACT

A solid ink stick feed system for use in a color printer is disclosed that utilizes a plurality of ink stick feed receptacles in an ink stick feed bin of predetermined shapes corresponding to the plurality of shapes of the ink sticks such that an incorrectly matched ink stick shape or incorrectly oriented ink stick is retained in a raised position to indicate to the printer operator that the ink stick should be removed and to facilitate grasping and removing such ink stick.

4 Claims, 3 Drawing Sheets

SOLID INK STICK FEED SYSTEM

FIELD OF THE INVENTION

This invention related generally to feeding ink sticks to a printer and, more specifically, to a color ink stick feed system for a phase change or solid ink color printer that prevents the wrong color ink stick from being fed to an ink stick loading bin where the ink stick is fed down an individual feed chute to the reservoir area where the different colored ink sticks are melted and stored in liquid form for ejection by the print head onto a receiving medium. The feed system provides easy visual indication and removal of an incorrectly colored ink stick in an ink stick receptacle when such incorrect feeding or misoriented insertion occurs.

BACKGROUND OF THE INVENTION

Solid ink jet printers were first offered commercially in the mid-1980's. One of the first such printers was offered by Howtek Inc. and used pellets of colored cyan, yellow, magenta and black ink that were fed into shape ceded openings that fed generally vertically into the heater assembly of the printer where they were melted into a liquid state for jetting onto the receiving medium. The pellets were fed generally vertically downwardly, using gravity feed, into the printer. These pellets were elongated and tapered on their ends with separate rounded, five, six, and seven sided shapes each corresponding to a particular color.

Later more successful solid ink printers, such as the Tektronix Phaser™ III, the Tektronix Phaser™ 300, and the Jolt printer offered by Data products Corporation, used differently shaped solid ink sticks that were either gravity fed or spring loaded into a feed chute and pressed against a heater plate to melt the solid ink into its liquid form. These ink sticks were shape coded and of a generally small size. One system utilized an ink stick loading system that initially feeds the ink sticks into a preload chamber and then loads the sticks into a load chamber by the action of a transfer lever. Earlier solid or hot melt ink systems used a flexible web of hot melt ink that is incrementally unwound and advanced to a heater location or vibratory delivery of particulate hot melt ink to the melt chamber. None of these systems had effective ways to either identify that an incorrectly colored ink was being loaded for feed to the incorrect color ink reservoir or a simple way to remove such incorrectly fed ink stick from the feed system.

As phase change ink color printers have increased their printing speed the need has developed to provide larger sized ink sticks so that refill of the ink reservoir in the print head is less frequent and more output or prints can be produced between refills. In designs where there is not a steep or generally vertical feed path to the heater plate, some provisions have been made to prevent the solid masses of shaped ink from sticking to the sides of the feed chutes so that an unrestricted feed of ink sticks proceed down into the heater plate for melting and filling of the individual colored ink reservoirs that are usually located within the print head. These larger sized ink sticks are fed into receptacles or openings in a cover plate over the feed chutes. If an ink stick is inadvertently inserted within the wrong receptacle it can be difficult for the printer operator to remove the ink stick, especially because of the sticky nature of the ink sticks waxy exterior surfaces that can cause them to become wedged in the incorrect ink stick receptacle. If an ink stick is incorrectly oriented within the correct receptacle, it can be difficult for the operator to identify the misorientation and remove the ink stick.

These problems are solved in the design of the present invention by providing a solid ink stick loading system and ink stick design for a plurality of ink stick colors wherein each ink color has a mutually exclusive shape and an ink stick feed cover with a corresponding distinctively shaped opening for each shape that cooperates with the ink sticks such that a correctly colored and shaped ink stick is permitted to drop therethrough into the ink stick feed bin for transmission to the reservoir and an incorrectly colored and shaped ink stick is retained in an elevated position, thereby indicating to the operator that the incorrect color is being fed into the ink stick color chute and facilitating its easy removal by the operator. Each ink stick has a flared portion about the periphery of its opposing sides that permit the ink stick to be retained in a raised position when fed to the incorrect color slot. Additionally, incorrectly oriented ink sticks fed into the correct ink stick receptacle are also retained in a raised position to facilitate identification and removal.

SUMMARY OF THE INVENTION

It is an aspect of the present invention to provide an ink stick feed system for a solid ink printer that prevents an incorrectly colored ink stick from being fed into the ink stick feed bin in the wrong location.

It is another aspect of the present invention to provide an ink stick feed system for a solid ink printer that permits an incorrectly colored ink stick to be easily identified and removed from the ink stick feed bin cover.

It is a feature of the present invention that the ink stick loading bin cover and the distinctive shapes of the inks sticks permit only the correctly colored and shaped ink stick to be fed into the appropriate colored ink stick feed bin slot for delivery to the heater melt plate and then into the ink reservoir.

It is another feature of the present invention that the flared portion of the opposing sides of the solid ink sticks permit the incorrectly colored and shaped ink sticks to be maintained in a raised position that is easily identified and removed from the ink stick feed bin cover.

It is still another feature of the present invention that the solid ink stick feed bin is conveniently located on the top of the color printer for easy operator access.

It is yet another feature of the present invention that the solid ink stick feeding system selectively permits the appropriately colored and shaped ink stick to be fed into the correct ink stick feed bin chute.

It is a further feature of the present invention that incorrectly oriented ink sticks placed into the correct ink stick receptacle are maintained in a raised position by supports within the ink stick feed chute to permit easy identification of the misorientation and removal.

It is an advantage of the present invention that incorrectly colored ink sticks are not fed into the ink stick feed bin in the wrong colored ink stick feed chute so that mixing of colors does not occur within the color printer print head.

It is another advantage of the present invention that improperly oriented ink sticks are not fed into the ink stick feed bin so that jamming of multiple ink sticks in the same ink stick feed chute is avoided.

It is another advantage of the present invention that full colored images can be made by the color printer without color contamination resulting from the wrong color solid ink stick being inadvertently fed into the ink stick feed bin.

These and other aspects, features and advantages are obtained by the solid ink stick feed system of the present invention that prevents the inadvertent misfeeding of the incorrectly colored ink stick into the wrong color chute in the ink stick feed bin and provides easy visual identification and removal of a potentially misfed solid ink stick.

BRIEF DESCRIPTION OF THE DRAWINGS

These and other aspects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
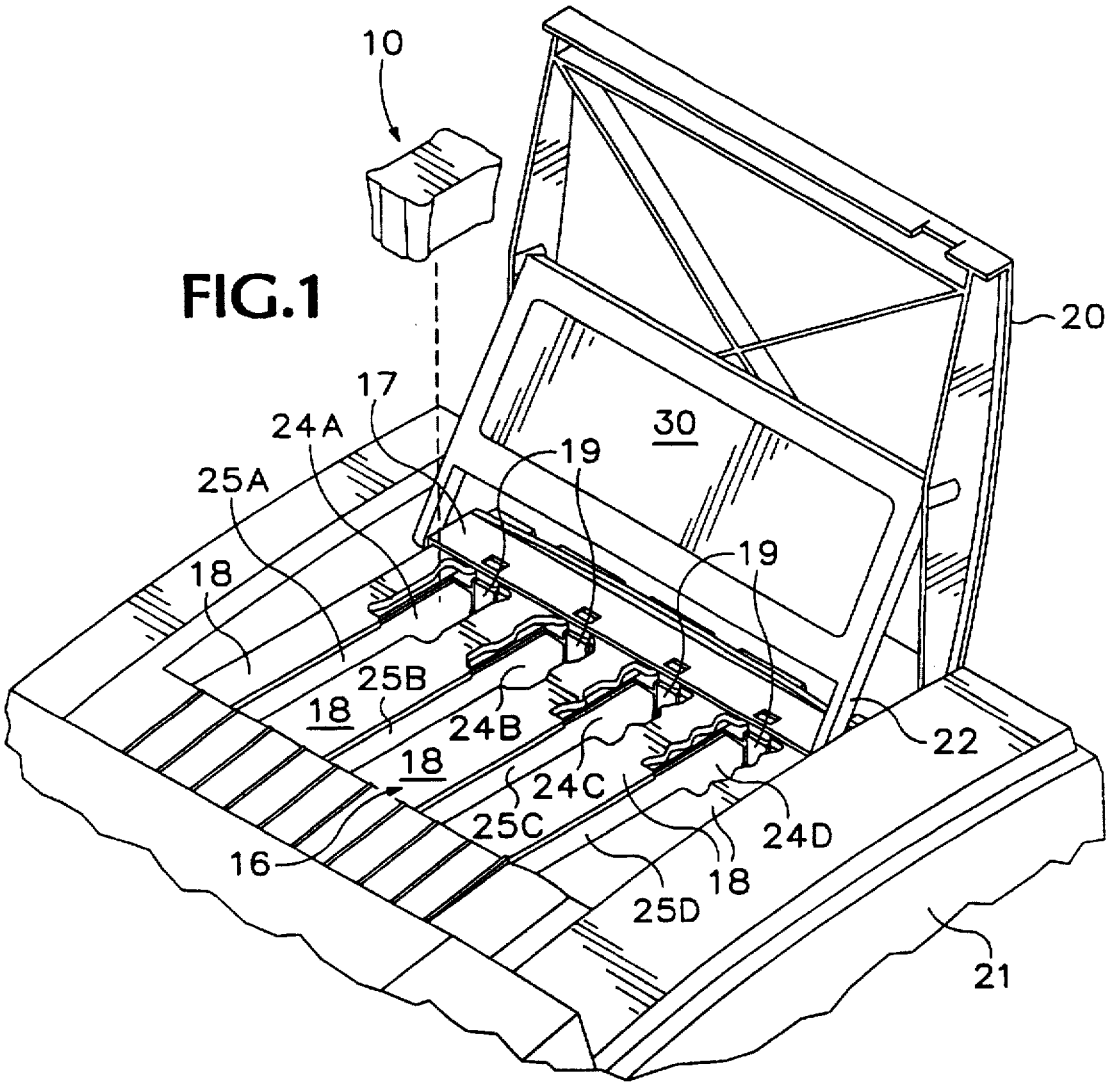
FIG. 1 is a partial top perspective view of a color printer with the printer top cover and the loading bin cover opened showing the solid ink stick loading bin and the ink stick feed cover or ink stick loading bin key plate with the distinctive color ink stick shaped receptacles or openings therein.

FIG. 1 discloses a portion of a solid ink stick printer with the printer top cover 20 raised so that the attached ink stick feed cover 30 is also raised, disclosing the ink stick loading bin with the key plate 18 positioned within the printer sidewalls 21. The feed cover 30 is pivotally mounted to the key plate 18 adjacent printer side frames 21 by pivot arms 22. An ink stick feed front cover plate or yoke 17 is mounted to the ink stick loading bin atop of the key plate 18 for sliding movement along the top of the key plate 18 to assist in moving the individual ink slicks (only one of which is shown), indicated generally by the numeral 10, forward in the feed chutes 25A–D toward the melt plates (not shown).

Ink slicks 10 are inserted into the appropriately shaped receptacles or openings 24A–D in the key plate 18 of the ink stick loading bin to feed the solid ink sticks down the corresponding ink stick feed chutes 25A–D to the melt plates (not shown) which melt the ink and feed it into the individual ink color reservoirs within the print head (also not shown) of the printer. The ink slicks 10 consist of the four primary colors of cyan, yellow, magenta and black, each having its own distinctive shape with a correspondingly shaped opening or receptacle 24A–D being provided in the key plate 18 to help ensure that the correct colored ink stick 10 is loaded into the appropriate and corresponding ink stick feed chute 25A–D to prevent color contamination of the inks in the individual color reservoirs (not shown) in the print head (also not shown), both of which are described in detail in copending U.S. patent application Ser. No. 08/610,564 entitled "High Performance Ink Jet Print Head Having An Improved Ink Feed System", filed Mar. 6, 1996

Figure 3:
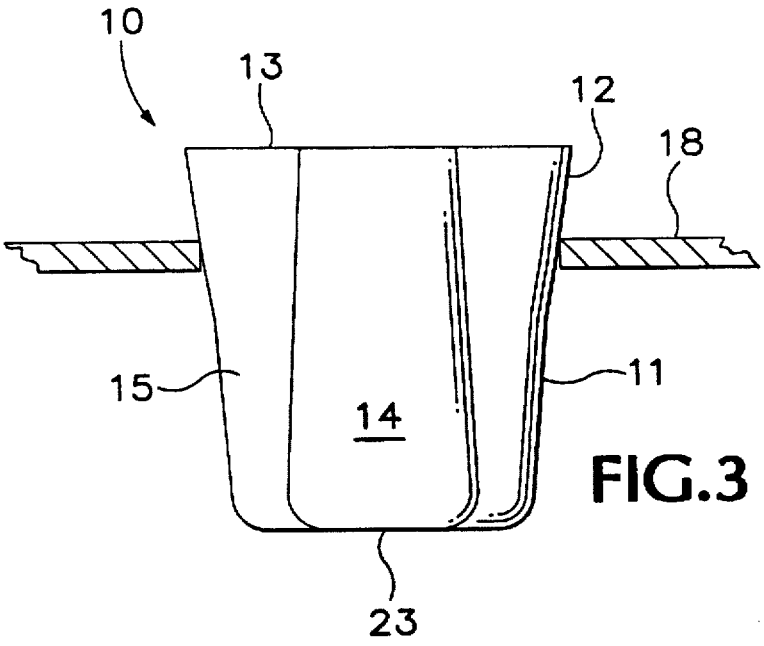
FIG. 3 is an end elevational view taken along the section lines 3—3 of FIG. 2 showing the incorrectly fed solid ink stick being held in the raised position by the interference of the ink stick feed cover with the flared side portions of the ink stick.

The ink sticks are generally tapered from their top 13 downwardly and inwardly to their bottom 23. The top 13 and bottom 23 of each stick 10 is connected by the tapered sides 11 with an upper flared portion 12. The opposing end portions 15, only one of which is best shown in FIG. 3, have a semi-protruding nose 14 in the center of each end to prevent or minimize jamming due to wedging along the sides of the appropriate individual ink stick feed chute 25A–D.

Figure 2:
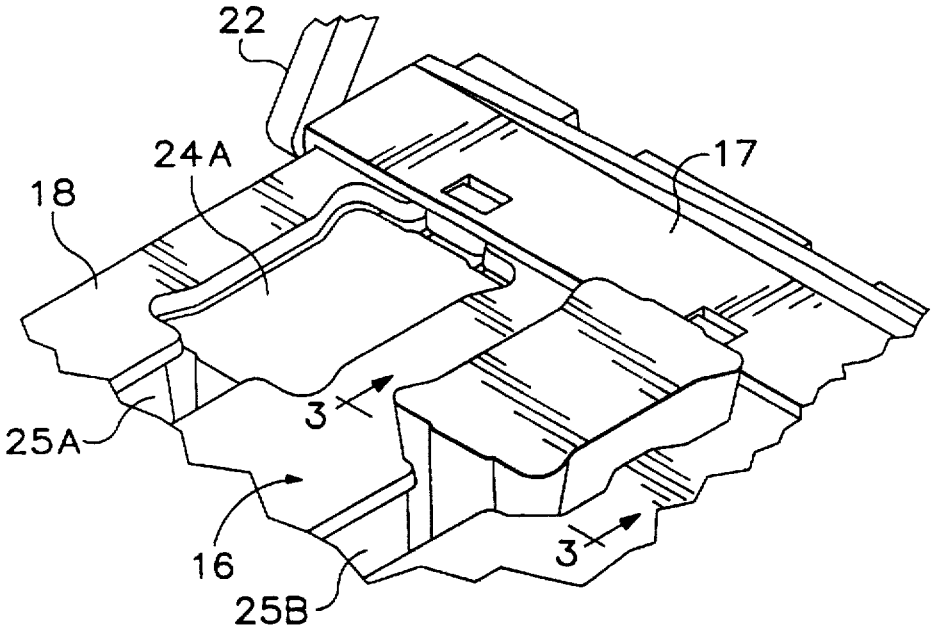
FIG. 2 is an enlarged partial top perspective view of the solid ink stick feed cover showing an incorrectly colored ink stick held in a clearly visible and easily removable raised position in an ink stick receptacle.

Incorrect loading of the ink sticks 10 generally can occur in one of two ways, either by loading the incorrect color and shaped ink stick in the incorrect key plate 18 receptacle or by inserting the correctly colored ink stick incorrectly in the correct receptacle. The former instance is shown in FIGS. 2 and 3 wherein an ink stick 10 is inserted into the wrong color and shaped receptacle 24B and is held in a raised position by the interference of the flared portion 12 of the tapered sides 11 of the ink stick 10 with the sides of receptacle 24B in the key plate 18. This raised retention provides a clear indication to the printer operator that the ink stick 10 has been placed in the incorrect receptacle, as well as permitting easy removal because the portion of the ink stick 10 extending above the key plate 18 is easily grasped and removed.

Figure 5:
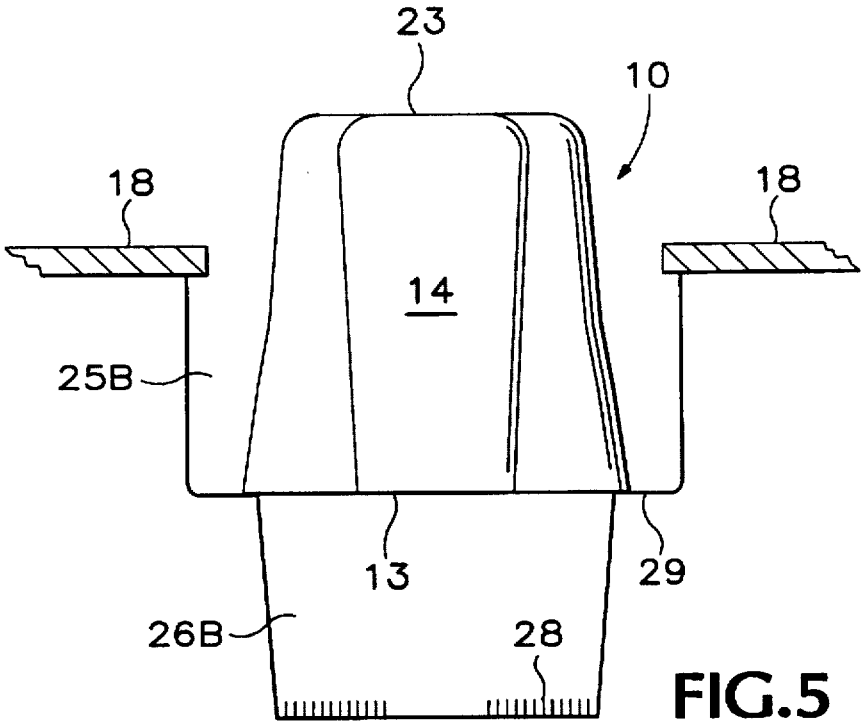
FIG. 5 is a diagrammatical illustration of an incorrectly oriented colored ink stick placed within the correct loading bin ink stick feed chute upside down with the incorrectly loaded solid ink stick being held in the raised position by the ink stick feed chute shoulders so that the solid ink stick extends above the top of the ink stick loading bin key plate in a clearly visible and easily removable position.

The second common instance of incorrect loading of an ink stick 10 into the ink stick loading bin 16 is shown in FIG. 5 where the ink stick 10 is loaded into the correct receptacle 24B, but it is placed in upside down so that the wider top 13 sits on top of the shoulders 29 in the chute 25B, preventing the stick 10 from settling into the bottom channel 26B. In this position the incorrectly loaded ink stick 10 extends above the key plate 18 in raised retention, again providing a clear indication to the printer operator that the ink stick 10 has been placed incorrectly in the correct receptacle. This again permits easy removal because the portion of the ink stick 10 extending above the key plate 18 is easily grasped and removed. Closure of printer top cover 20 is prevented in this instance by the interference of the yoke 17 with the portion of the raised ink stick 10 extending above the key plate 18.

Figure 4:
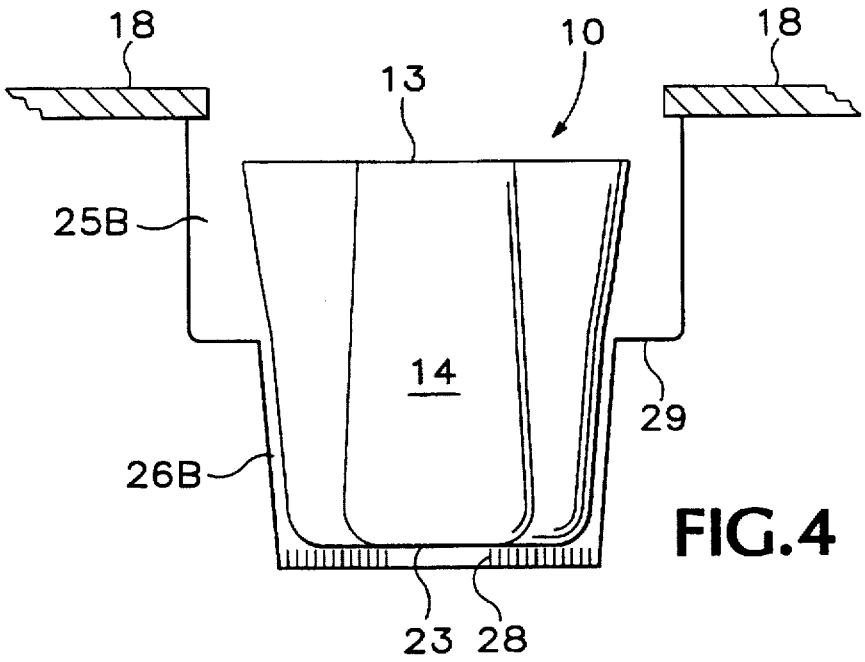
FIG. 4 is a diagrammatical illustration of a correctly colored ink stick placed within the correct loading bin ink stick feed chute with the solid ink stick sitting in the recessed feed chute bottom channel and beneath the ink stick loading bin key plate.

Each chute 25A–D has a pair of shoulders 29 and a bottom channel 26 into which the properly inserted ink stick 10 should extend to permit it to be fed the length of the appropriate chute 25A–D to the melt plate (not shown). A friction reducing material 28, such as a felt or polyester fiber, may be employed to facilitate sliding of the ink sticks down the appropriate chute 25A–D. FIG. 4 shows a correctly positioned ink stick 10 in the correct ink stick chute 25B.

In use, the operator initially loads or reloads the ink stick loading bin 16 of the color printer with ink sticks 10 by placing the appropriately colored and shaped ink sticks in the corresponding appropriately shaped ink stick receptacle 24A–D that permits the ink stick 10 to fall into the appropriate feed chute 25A–D. If the ink stick 10 is placed in the incorrect receptacle 24A–D, the tapered sides 11 interfere with the sides of the ink stick receptacle 24A–D and the ink stick is held in a raised position, best seen in FIGS. 2 and 3. The operator then grasps the exposed portion of the ink stick 10 and removes it from the incorrect receptacle prior to insertion in the correct receptacle in the key plate 18. If the correct ink stick 10 is improperly inserted in the correct receptacle 24A–D, as seen in FIG. 5, the ink stick 10 is supported by the shoulders 29 so that the exposed portion extending above the top of the key plate 18 is readily visible and is easily removed and reinserted with the proper orientation by the operator. Once all of the ink sticks 10 are properly inserted, the printer top cover 20 and the connected feed cover 30 are closed and the feed cover yoke or front plate 17 with the individual chute pusher blocks 19 is spring loaded against the ink sticks 10 to urge them down the chutes 25A–D until the front ink stick 10 in each chute 25 is pressed against the heated melt plates and the ink is melted into the individual colored reservoirs within the print head.

While the invention has been described above with reference to specific embodiments thereof, it is apparent that many changes, modifications and variations in the materials, arrangements of parts and steps can be made without departing from the inventive concept disclosed herein. For example, in employing the improved solid ink stick feed system of the present invention, it should be noted that ink sticks of any shape could be employed as long as the ink stick key plate has the correspondingly shaped receptacle or opening therein to control the selective feeding of the ink sticks into the appropriate ink stick feed chute. Similarly, the invention can be used for color printers where a plurality of different colors are employed or for a gray scale printer where different shades of black are employed to ensure contamination of the colors in the individual ink reservoirs within the print head does not occur.

Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

Having thus described the invention, what is claimed is:

1. A solid ink stick feed system for a printer selectively permitting ink sticks of a predetermined shape to be fed into the printer and not permitting improperly oriented ink sticks to be fed, the system providing visual indication of improper matching of the ink stick orientation to an ink stick receptacle, the system comprising in combination:

a. an ink stick feed bin having areas for receipt of a plurality of ink sticks, the ink sticks having at least one shape and a plurality of colors;

b. a plurality of receptacles within the ink stick feed bin corresponding to the plurality of distinctive ink stick colors, each receptacle having elongated opposing side walls defining an ink stick feed chute, each ink stick feed chute having underlying opposing shoulders formed in the opposing sidewalls and a bottom underlying the opposing shoulders such that an ink stick not oriented correctly will not be fed into the ink stick feed chute and will be retained in a raised position to indicate to the printer operator that the incorrectly oriented ink stick should be removed; and c. a plate for the ink stick feed bin having a plurality of openings overlying the plurality of receptacles to permit access of the ink sticks into the plurality of receptacles.

2. The solid ink stick feed system according to claim 1 further comprising the opposing sidewalls of the ink stick feed chutes are stepped and at least partially tapered from the opposing shoulders downwardly to the bottom to form a channel such that an incorrectly oriented ink stick contacts the opposing shoulders and is thereby held in the raised position and a correctly oriented ink stick fits between the at least partially tapered opposing sidewalls below the opposing shoulders and into the channel.

3. The solid ink stick feed system according to claim 1 further comprising a printer top cover connected to a pivotally articulated ink stick feed cover, both the printer top cover and the ink stick feed cover being movable between a first closed position and a second raised or open position to permit the insertion of properly oriented ink sticks through openings in the plate covering the ink stick feed bin into the receptacles.

4. The solid ink stick feed system according to claim 3 further comprising pusher blocks and a slidable yoke connected to the ink stick feed cover so that upon movement of the ink stick feed cover from the second open position to the first closed position, the pusher blocks are loaded against ink sticks in each ink stick feed chute to urge the ink sticks down each chute.

* * * * *